United States Patent [19]

Jackson et al.

[11] Patent Number: 4,828,248

[45] Date of Patent: May 9, 1989

[54] APPARATUS FOR STACKING COPY SHEETS IN INVERTED ORIENTATION

[75] Inventors: Richard W. Jackson, Barrington; Eugene P. Oddo, Mt. Prospect; Larry A. Songer, Schaumburg, all of Ill.

[73] Assignee: AM International, Inc., Chicago, Ill.

[21] Appl. No.: 602,778

[22] Filed: Apr. 23, 1984

[51] Int. Cl.[4] ..... B65H 29/54

[52] U.S. Cl. ..... 271/310; 271/186

[58] Field of Search ..... 271/186, 65, 66, 67, 271/68, 69, 70, 306, 307, 310

[56] References Cited

U.S. PATENT DOCUMENTS 4,300,757 11/1981 Koiso et al. ..... 271/186 X

*Primary Examiner*—Joseph J. Rolla

*Attorney, Agent, or Firm*—Nicholas A. Camasto; John R. Hoffman

[57] ABSTRACT

An apparatus for collecting and stacking in an inverted orientation large copy sheet discharged from the exit port of a whiteprint, blueprint or similar copying machine. A receptacle trough is provided for arresting and captivating the leading edges of the copy sheets as the sheets are discharged seriatim from the exit port of the machine. A stacking tray is disposed adjacent the receptacle trough for receiving the copy sheets inverted and in sequential order while the sheets remain captivated by the receptacle trough.

5 Claims, 1 Drawing Sheet

APPARATUS FOR STACKING COPY SHEETS IN INVERTED ORIENTATION

BACKGROUND OF THE INVENTION

This invention relates generally to copying machines and particularly to apparatus for collecting in an inverted orientation relatively large copy sheets discharged from a whiteprint, blueprint or similar copying machine.

It is widely known to provide stacking devices or trays at the exit ends of copying machines for collecting copy sheets and neatly stacking the sheets for removal from the machine. It also is known to provide such stacking devices with means for inverting or reversing the orientation of the sheets exiting from the machine so that the sheets are in sequential order, normally with the printed side down. However, such inverting devices normally have been designed for relatively small copy sheets and often rely upon the inherent stiffness of the sheets to facilitate the inverting process. For instance, U.S. Pat. No. 4,300,757, dated Nov. 17, 1981, discloses an apparatus for facially reversing or overturning copy sheets as they exit from a copying machine. In that patent, the copy sheets issue from the machine and seriatim strike a guide which deflects the sheets into a stacking tray where the sheets fall printed-side down into the tray. As with most such devices, the inherent stiffness of the relatively small copy sheets is utilized to advantage in the deflecting and stacking process.

Reverse stacking devices as described above are not applicable for use with whiteprint, blueprint or similar copying machines which handle relatively large copy sheets. For instance, such machines often use the diazo process where a translucent original is placed upon a relatively large sheet of sensitized diazo coated copy paper and the two sheets are fed together through the machine. The sheets are carried around a transparent cylinder which contains an ultraviolet lamp. Wherever the light passes through the original to the copy the sensitized coating on the copy is decomposed leaving the copy paper white. Wherever the image on the original shields the copy paper from the light the sensitized coating will remain as a latent image. After being separated from the original, the exposed copy paper passes into a developer section where ammonia vapors combine with the diazo coating in the latent image to form a highly legible permanent image on a clear white background. The copy then emerges from the machine as a flat, dry print ready for immediate use. This is but one type of copying machine with which the present invention is applicable, in that the size of the copy sheets may be as large as 36 x 42 inches.

It is readily apparent that because of the large size sheets used in whiteprint and blueprint copying machines, most known inverting or reversing stacking devices cannot be employed because of the lack of inherent stiffness in the large size copy sheets. In essence, the large sheets are somewhat "limp" as they emerge from the copying machine.

There is a definite need for a simple apparatus for collecting and inverting the orientation of large copy sheets discharged from a whiteprint, blueprint or similar copying machine. The present invention is directed to fulfilling this need.

SUMMARY OF THE INVENTION

An object, therefore, of the invention is to provide a new and improved stacking device for copy sheets emerging from a copying machine.

A further object is to provide a stacking apparatus for collecting in an inverted or reverse orientation large copy sheets discharged from such copying machines as whiteprint, blueprint or similar machines.

In the exemplary embodiment of the invention, the apparatus includes receptacle means for arresting and captivating the leading edges of copy sheets as the sheets are discharged seriatim from the exit port of the copying machine. Stacking means are provided adjacent the receptacle means for receiving the copy sheets inverted and in sequential order while the sheets remain captivated by the receptacle means.

The receptacle means comprise a trough positioned directly below the exit port of the machine. The trough includes a bottom wall for arresting the leading edges of the copy sheets and a forward wall adjacent the rear of the machine for preventing the leading ends of the sheets from bowing forwardly. Many large copying machines, particularly in the diazo process, have a normal vacuum created within the machine. The forward wall of the trough is provided with air passages communicating with the interior of the copying machine whereby the normal vacuum created therein can act on the copy sheets to facilitate directing the sheets by gravity into the trough.

The stacking means include a stacking tray adjacent the trough and extending rearwardly of the machine. The stacking tray includes a forward end vertically disposed intermediate the exit port of the machine and the bottom wall of the trough. Therefore, each copy sheet bows naturally by gravity over the forward end of the stacking tray and onto the tray as the leading end of the sheet remains captivated by the trough or receptacle means. In essence, the forward end of the stacking tray is disposed a sufficient distance above the bottom wall of the trough whereby a lip is formed in each copy sheet as it bows onto the stacking tray to facilitate captivating the sheet, by friction, between the trough and the forward end of the stacking tray. Preferably, the stacking tray is disposed in a downward inclination at an acute angle leading away from the forward end thereof.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
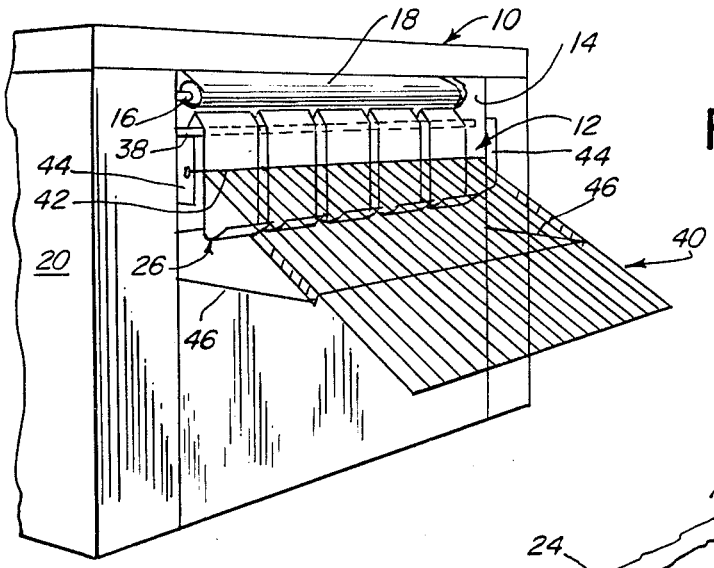
FIG. 1 is a fragmented perspective view of a copying machine with the reverse stacking apparatus of the invention disposed at the exit end or rear of the machine.

Referring to the drawings in greater detail, and first FIG. 1, the rear or back side of a console copying machine, generally designated 10, is illustrated with a reverse stacking apparatus, generally designated 12, in accordance with the invention mounted adjacent the rear or exit port 14 of the machine. Printed copy sheets emerge from the machine through port 14 by means of an exit roller 16 and a discharge belt 18 which passes over the roller.

Copying machine 10 includes a body or housing 20 which contains the interior components of the machine. For instance, the machine may use the diazo process and all of the components related therewith, including feed rollers, ultraviolet lamp cylinders, fans, developer sections and the like are disposed inside the housing. For purposes described hereinafter, fans are used in the diazo process to exhaust ammonia vapors used in developing the latent image on the copy sheets. Consequently, normally a vacuum is created at exit port 14 of the machine. This vacuum can be used advantageously with the reverse stacking device of the invention.

Of course, machines as described herein are capable and most often handle relatively large size copy sheets. It would not be unusual for the machine to rapidly handle sheets of a size on the order of 24×42 inches or 36×42 inches. Because of the sheet size, the sheets exit from the machine somewhat "limp" and difficult to handle. Heretofore, the sheets normally exited from the machine and simply were deposited on a wire rack, print-side up. The resultant stack of sheets is in non-chronological order. The invention is directed to providing a stacking device or apparatus which receives and reverses the copy sheets emerging from the copying machine so that the sheets are stacked seriatim in sequential order with the print-side down.

Figure 2:
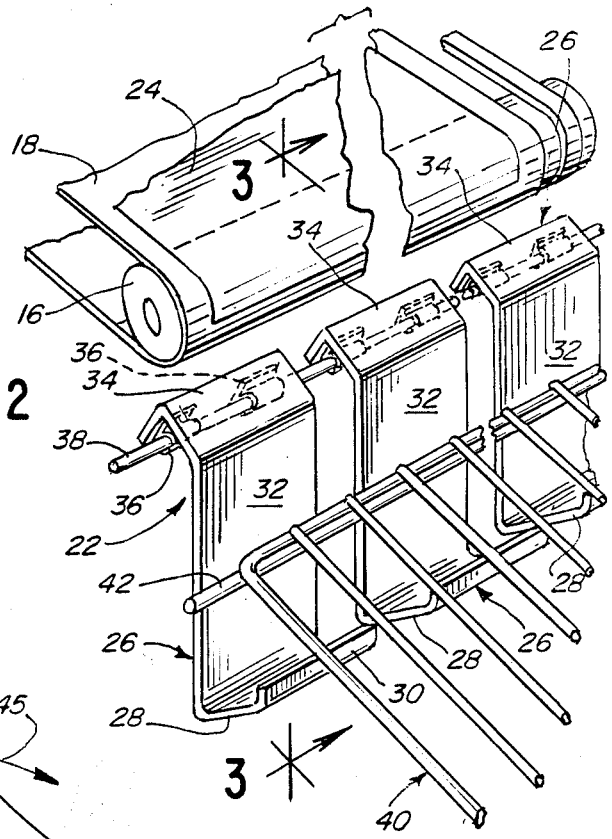
FIG. 2 is a fragmented perspective view, on an enlarged scale, of the components of the reverse stacking apparatus in conjunction with the exit or discharge portion of the machine.

More particularly, referring to FIG. 2 as well as FIG. 1, the reverse stacking device 12 includes receptacle means, generally designated 22, which define a trough for arresting and captivating the leading edges of copy sheets 24 (FIG. 2) as the sheets are discharged seriatim from belt 18 through exit port 14. The receptacle means are defined by a plurality of trough sections 26. Each trough section includes a bottom wall 28 for arresting the leading edges of the copy sheets, a small lip 30 along the rear edge of the bottom wall, and a forward wall 32 for preventing the leading ends of the copy sheets from bowing forwardly. Each trough section also includes a generally L-shaped flange 34 along the upper edge of forward wall 32. A plurality of resilient C-clamp structures 36 are secured to the underside of flange 34 for clamping each trough section 26 onto a rod 38 which extends transversely across exit port 14 directly beneath exit roller 16 and the discharge end of belt 18. Thus, the trough sections are easily snapped onto and off of rod 38 for replacement or modification purposes, as well as gaining access to the interior of the machine through exit port 14. Furthermore, some existing copying machines are structured with a support rod, such as rod 38, and the trough sections can be readily mounted on an existing machine by use of the snap-on C-clamps.

It can be seen that trough sections 26 are spaced along rod 38 and thereby define air passages between adjacent trough sections. These air passages communicate with the interior of the copying machine through exit port 14. As described above, most such machines have a normal vacuum within the machine created by the fans for exhausting fumes from the machines, such as the ammonia fumes in a diazo process. The receptacle means defined by trough sections 26 takes advantage of this vacuum by spacing the trough sections relative to each other. Therefore, the vacuum between adjacent trough sections acts on each copy sheet to draw the copy sheet against forward walls 32 of the trough sections and thereby facilitates directly the leading end of the copy sheet into the trough defined by the sections.

Still referring FIGS. 1 and 2, the reverse stacking device of the invention includes stacking means in the form of a wire frame stacking tray, generally designated 40. The stacking tray includes a forward end defined by a transverse rod 42 mounted between a pair of end flanges 44 protruding rearwardly from the machine. The stacking tray is supported in a projecting disposition rearwardly of the machine by a pair of support rods 46 extending between the rear of the machine and the stacking tray. The support rods may be removably mounted to the tray in any known fashion to permit the tray to be folded to a storage position overlying the rear of the machine. Support rods 46 are of a length so that stacking tray 40 is disposed in a downward inclination leading away from forward end 42 thereof.

Figure 3:
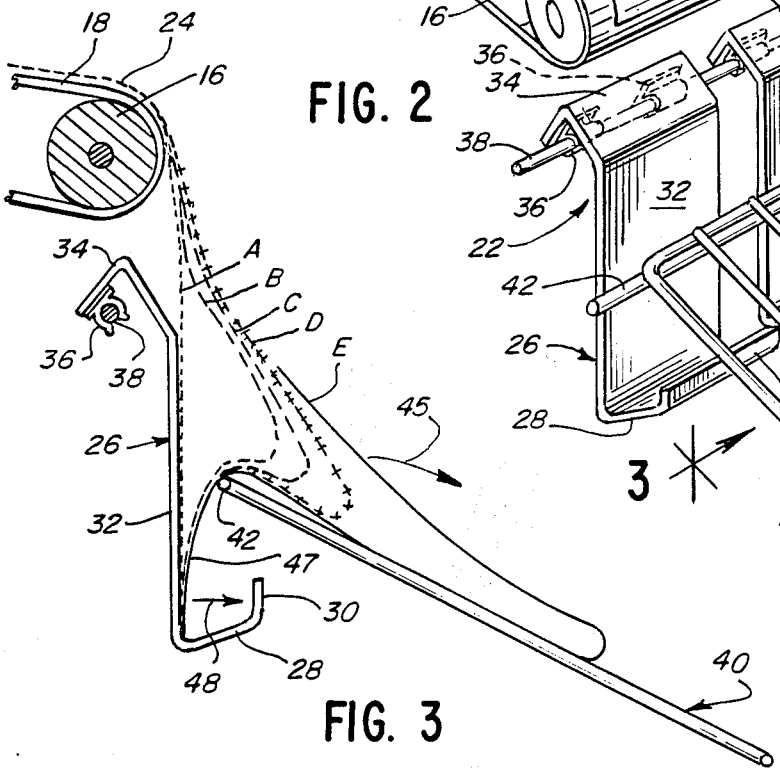
FIG. 3 is a fragmented section taken generally along the line 3—3 of FIG. 2, and illustrating various positions of a copy sheet as it exits from the machine and folds onto the reverse stacking apparatus of the invention.

Referring to FIG. 3, it can be seen that the forward end of stacking tray 40, defined by transverse rod 42, is vertically disposed intermediate the exit port of the machine and bottom walls 28 of trough sections 26. This is important to form a lip over which each copy sheet bows as it progressively discharges from the machine and onto the stacking tray. In essence, each sheet itself, being captivated by trough sections 26, forms a sufficient lip within the receptacle means defined by the trough sections whereby sufficient friction retains the sheet captivated as a succeeding sheet is discharged from the machine into the trough, as described below.

More particularly, FIG. 3 illustrates by various line configurations designated "A" through "E" the progression of a copy sheet as it emerges from the machine off of discharge belt 18, into the receptacle means defined by trough sections 26 and onto stacking tray 40 in an inverted or reverse orientation: namely, print-side down. Specifically, "A" shows a copy sheet emerging from the machine into the trough sections with the leading edge of the sheet being arrested by bottom wall 28 of the trough sections. It can be seen that the leading end of the sheet adheres closely to forward walls 38 of the trough sections. This is facilitated by the normal vacuum within the machine acting through the spaces between adjacent trough sections, as described above. "B" through "D" shows the sheet progressively bowing toward and over the forward end of stacking tray 40. This action develops because of the normal weight of the large sheets overcoming the suction from within the machine and naturally bowing onto the stacking tray. "E" illustrates the sheet about to leave discharge belt 18 whereupon the sheet will progressively bow onto the stacking tray until the sheet flips over in the direction of arrow 45 and comes to rest on the stacking tray, print-side down. The disposition of the forward end of the stacking tray above the bottom walls of the trough sections develops a sufficient lip 47 in the sheet to maintain the sheet captivated with the leading end retained in the receptacle means defined by the trough sections. Each successive sheet will follow this same progression as the sheets are discharged from the machine and the sheets will be collected in a neat stack or stacking tray 40. As the leading edge of each sheet enters the trough sections, lips 47 of the preceding sheets simply will move forwardly in the direction of arrow 48 under their own flexibility until the receptacle means is filled by the first sheet abutting against lips 30 along the rear edges of the trough sections. Of course, any selected number of copy sheets may be stacked, within the described limit, and the leading ends of the sheets will be successively captivated by the trough sections and the forward end of the stacking tray.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An apparatus for collecting in inverted orientation large copy sheets such as blueprints, whiteprints or the like discharged from the exit port of a copying machine, comprising:

receptacle means disposed below said exit port and including bottom wall means for arresting the leading edges of said copy sheets and forward wall means substantially in line with and below said exit port for preventing the leading ends of the sheets from bowing forwardly; and a stacking tray adjacent said receptacle means and including a forward end vertically disposed intermediate said exit port and said bottom wall means of the receptacle means, said forward end of said stacking tray forming an abrupt edge disposed a sufficient distance directly above said bottom wall means of the receptacle means, and said stacking tray being disposed in a downward inclination leading away from said forward end thereof, whereby each copy sheet bows naturally by gravity over said forward end onto the stacking tray forming an acute lip in the copy sheet as the leading end of the sheet remains captivated between the wall means of said receptacle means and the abrupt edge of said stacking tray.

2. An apparatus for collecting in inverted orientation large copy sheets discharged from the exit port of a whiteprint, blueprint or similar copying machine, comprising:

receptacle means for arresting and captivating the leading edges of said copy sheets as the sheets are discharged seriatim from said exit port, said receptacle means being disposed below said exit port and including forward wall means against which the leading end of a copy sheet can abut as the leading edges of the copy sheets enter the receptacle means by gravity, and air passage means communicating with the interior of the copying machine whereby normal vacuum created within the machine can act on the copy sheets to facilitate directing the sheets into the receptacle means; and a stacking tray for receiving said copy sheets inverted and in sequential order while the sheets remain captivated by said receptacle means, said stacking tray having a forward end vertically disposed intermediate said exit port and a bottom portion of said receptacle means.

3. An apparatus for collecting in inverted orientation large copy sheets discharged from the exit port of a whiteprint, blueprint or similar copying machine, comprising:

receptacle means for arresting and captivating the leading edges of said copy sheets as the sheets are discharged seriatim from said exit port;

stacking means adjacent said receptacle means for receiving said copy sheets inverted and in sequential order while the sheets remain captivated by said receptacle means; and said copying machine including means for creating a vacuum in the area of said exit port, and said receptacle means includes air passage means communicating with the interior of the copying machine whereby said vacuum can act on said copy sheets to facilitate directing the sheets into said receptacle means.

4. An apparatus for collecting in inverted orientation large copy sheets discharged from the exit port of a whiteprint, blueprint or similar copying machine, comprising:

receptacle means disposed below said exit port and including bottom wall means for arresting the leading edges of said copy sheets and forward wall means for preventing the leading ends of the sheets from bowing forwardly, said forward wall means of said receptacle means including air passage means communicating with the interior of the copying machine whereby normal vacuum created within the machine can act on the copy sheets to facilitate directing the sheets into said receptacle means; and a stacking tray adjacent said recetacle means and including a forward end vertically disposed intermediate said exit port and said bottom wall means of the receptacle means, whereby each copy sheet bows naturally by gravity over said forward end onto the stacking tray as the leading end of the sheet remains captivated by said receptacle means, the forward end of said stacking tray being disposed a sufficient distance above the bottom wall means of said receptacle means whereby a lip is formed in each copy sheet as it bows onto the stacking tray to facilitate captivating the sheet in said receptacle means.

5. An apparatus for collecting in inverted orientation large copy sheets discharged from the exit port of a whiteprint, blueprint or similar copying machine, comprising:

receptacle means disposed below said exit port and including bottom wall means for arresting the leading edges of said copy sheets and forward wall means for preventing the leading ends of the sheets from bowing forwardly;

a stacking tray adjacent said receptacle means and including a forward end vertically disposed intermediate said exit port and said bottom wall means of the receptacle means, whereby each copy sheet bows naturally by gravity over said forward end onto the stacking tray as the leading end of the sheet remains captivated by said receptacle means; and said copying machine including means for creating a vacuum in the area of said exit port, and said receptacle means includes air passage means communicating with the interior of the copying machine whereby said vacuum can act on said copy sheets to facilitate directing the sheets into said receptacle means.

* * * * *